US008123823B2

(12) United States Patent
Hobson et al.

(10) Patent No.: US 8,123,823 B2
(45) Date of Patent: Feb. 28, 2012

(54) HIGH SOLIDS CONTENT DISPERSIONS

(75) Inventors: David Hobson, Belper (GB); Benjamin Boulay, Palaiseau (FR); Alexander F. Psaila, Belper (GB)

(73) Assignee: The Lurbizol Corporation, Wickliffe, OH (US)

( * ) Notice: Subject to any disclaimer, the term of this patent is extended or adjusted under 35 U.S.C. 154(b) by 298 days.

(21) Appl. No.: 10/598,577

(22) PCT Filed: Mar. 31, 2005

(86) PCT No.: PCT/US2005/010631

§ 371 (c)(1),
(2), (4) Date: Jan. 16, 2007

(87) PCT Pub. No.: WO2005/097952

PCT Pub. Date: Oct. 20, 2005

(65) Prior Publication Data

US 2008/0229655 A1 Sep. 25, 2008

Related U.S. Application Data

(60) Provisional application No. 60/613,916, filed on Sep. 28, 2004, provisional application No. 60/558,052, filed on Mar. 31, 2004.

(51) Int. Cl.

| | |
|---|---|
| ***C10L 1/18*** | (2006.01) |
| ***C10L 1/12*** | (2006.01) |
| ***C10M 103/00*** | (2006.01) |
| ***C10M 103/06*** | (2006.01) |

(52) U.S. Cl. ..... 44/457; 44/403; 44/463; 508/154; 508/165; 508/178

(58) Field of Classification Search ..... 508/391, 508/165, 178; 507/119; 429/12; 524/436, 524/589; 44/457, 403, 463
See application file for complete search history.

(56) References Cited

U.S. PATENT DOCUMENTS

| | | | | |
|---|---|---|---|---|
| 2,394,907 | A | 2/1946 | Gallay et al. | |
| 2,434,539 | A | 1/1948 | Beerbower et al. | |
| 3,525,599 | A | 8/1970 | Nield et al. | |
| 3,547,605 | A | 12/1970 | Cornelius, III et al. | |
| 4,094,801 | A * | 6/1978 | Forsberg | 508/391 |
| 4,200,544 | A | 4/1980 | Forsberg | |
| 4,251,600 | A * | 2/1981 | Sim et al. | 429/12 |
| 5,461,101 | A * | 10/1995 | Rothon et al. | 524/436 |
| 5,851,961 | A * | 12/1998 | Magyar | 507/119 |
| 2004/0260013 | A1 * | 12/2004 | Richards | 524/589 |

FOREIGN PATENT DOCUMENTS

| | | | |
|---|---|---|---|
| EP | 0288 296 A1 | | 10/1988 |
| GB | 1061161 | * | 3/1967 |
| GB | 1180533 | | 6/1967 |
| GB | 1315304 | | 5/1973 |
| WO | 2004/026996 A1 | | 4/2004 |

* cited by examiner

*Primary Examiner* — Ellen McAvoy
*Assistant Examiner* — Chantel Graham
(74) *Attorney, Agent, or Firm* — Samuel B. Laferty

(57) ABSTRACT

The present invention provides a dispersion composition containing (a) a metal base selected from the group consisting of: (i) a metal hydroxide with a solids content of greater than about 51 wt % of the composition; (ii) a metal base other than a metal hydroxide with a solids content of greater than about 15 wt % of the composition; and (iii) mixtures thereof; (b) a surfactant; and (c) an organic medium containing less than about 2 wt % of water. The invention further provides a process for preparing the composition and a method for its use.

16 Claims, No Drawings

HIGH SOLIDS CONTENT DISPERSIONS

CROSS REFERENCE

This application claims priority from PCT Application Ser. No. PCT/US2005/010631 filed on Mar. 31, 2005, which claims benefit from Provisional Application Ser. No. 60/613,916 filed on Sep. 28, 2004 and on Provisional Application Ser. No. 60/558,052 filed on Mar. 31, 2004.

FIELD OF INVENTION

The present invention relates to a composition containing a metal base; a surfactant; an organic medium containing less than about 2 wt % of water; and optionally a carboxylic acid. The invention further provides a process for making the composition and a method for its use.

BACKGROUND OF THE INVENTION

It is well known how to prepare a dispersion containing a metal base that is normally insoluble in an oil of lubricating viscosity such as lithium hydroxide. The dispersion containing the metal base has a low solids content (i.e. the amount of metal base in the dispersion) typically up to about 10 wt %. A dispersion of this type with a solids content greater than about 10 wt % are unstable without the presence of a large amount of surfactant to stabilise the dispersion against the metal base dropping out and forming sediment. Also a low solids dispersion contains a large amount of a carrier medium (often an oil of lubricating viscosity) and this makes transportation, storage, and dispensing of said dispersion difficult due to the volume of the medium. Furthermore, this makes the dispersion less environmentally friendly and expensive.

International Publication WO 04/026996 discloses a fuel additive composition capable of reducing vanadate deposits. The composition contains a metal inorganic oxygen containing compound, a liquid soluble in oil and a dispersant including fatty acid or ester derivatives thereof.

U.S. Pat. No. 3,067,018 discloses a colloidal additive for a fuel comprising a magnesium hydroxide with a solids content of 35 weight percent or less of the colloidal additive.

International Publication WO 03/044138 discloses a composition containing an oil of lubricating viscosity, at least one emulsifier capable of forming a water-in-oil emulsion, a base and optionally an oil insoluble solvent. The base includes metal salt of a hydroxide, a carbonate, a bicarbonate or an amine salt of an organic acid. The composition does not disclose a dispersion with a high solids content. Furthermore the dispersion is suitable for marine lubricants.

U.S. Pat. No. 2,434,539 discloses that a strong metal hydroxide may be made more reactive to high molecular weight organic fatty acids by heating the metal hydroxide crystals in the presence of a liquid hydrocarbon to a temperature and for a sufficient time to drive off all water of crystalisation i.e. at a temperature above 107° C.

U.S. Pat. No. 2,394,907 discloses suspending an alkali or other saponification agent in a non-reactive liquid medium and mechanically comminuting the alkali in oil until a predominant portion of the particles of alkali is as low as 5 micrometers in size. The resultant alkali is then used to make grease.

U.S. Pat. No. 4,075,234 relates to grease manufacture using a concentrated aqueous solution of lithium hydroxide in a liquid reaction mixture comprising an alkyl nitrile.

U.S. Pat. No. 4,337,209 relates to a method of preparing soap and greases by reacting an organic carboxylic acid, its esters and mixtures thereof with a concentrated aqueous solution of alkali metal hydroxide in the presence of an inorganic salt, in a liquid reaction medium comprising acetone. The presence of the inorganic salt increases the yield of the soap or grease.

U.S. Pat. No. 5,236,607 relates to a process for preparing a lithium soap thickened grease which consists of heating a mixture of oil and a lithium base to at least 100° C., then heating the resulting mixture at a temperature in the range of 110° C. to 200° C. until a thickened grease is obtained. After the grease is formed it is subjected to a homogenization/milling process resulting in a smooth grease.

It would be desirable to have a dispersion composition with a high solids content. The present invention provides a dispersion composition capable of providing a composition with a high solids content.

It would be desirable to have a dispersion composition with a high solids content capable of being used as a thickener for grease manufacture. The present invention provides a dispersion composition capable of being used as a thickener for grease manufacture.

It would be desirable to have a dispersion composition with a small particle size with a high solids content and with a low viscosity. The present invention provides a dispersion composition with a small particle size with a high solids content and with a low viscosity.

SUMMARY OF THE INVENTION

The present invention provides a composition comprising a dispersion of:

(a) a metal base selected from the group consisting of:
  (i) a metal hydroxide;
  (ii) a metal base other than a metal hydroxide; and mixtures thereof;
(b) a surfactant; and
(c) an organic medium containing less than about 2 wt % of water, wherein said metal base is present in at a solids content greater than about 51 wt % of the composition when the base is a metal hydroxide and at a solids content of greater than 15 wt % when said metal base is other than a metal hydroxide or is a mixture.

In one embodiment the invention further provides a fuel composition comprising:

(a) a dispersion comprising:
  (i) a surfactant other than a fatty acid or derivatives thereof;
  (ii) a metal base with a solids content of greater than about 35 wt % of the dispersion; and
  (iii) an organic medium containing less than about 2 wt % of water; and
(b) a liquid fuel.

The invention further provides a process for preparing a composition comprising the steps of:

(1) mixing (a) a metal base; (b) a surfactant and (c) an organic medium containing less than about 2 wt % of water to form a slurry:
(2) grinding the slurry of step (1) to form a dispersion;
(3) optionally heating the dispersion of step (2) to a temperature to about 40° C. to about 190° C. to form a finer dispersion;
(4) optionally reacting the dispersion of steps (2) or (3) with a carboxylic acid containing about 2 to about 30 carbon atoms, wherein the carboxylic acid is a monocarboxylic acid, a polycarboxylic acid or mixtures thereof, and optionally the carboxylic acid is further substituted with groups selected from a hydroxyl group, an ester and mixtures thereof.

DETAILED DESCRIPTION OF THE INVENTION

The present invention provides a composition comprising a dispersion of:

(a) a metal base selected from the group consisting of:
  (i) a metal hydroxide;
  (ii) a metal base other than a metal hydroxide; and
  (iii) mixtures thereof;
(b) a surfactant; and
(c) an organic medium containing less than about 2 wt % of water, wherein said metal base is present in at a solids content greater than about 51 wt % of the composition when the base is a metal hydroxide and at a solids content of greater than 15 wt % when said metal base is other than a metal hydroxide or is a mixture.

In one embodiment the invention further provides a fuel composition comprising:

(a) a dispersion comprising:
  (i) a surfactant other than a fatty acid or derivatives thereof;
  (ii) a metal base with a solids content of greater than about 35 wt % of the dispersion; and
  (iii) an organic medium containing less than about 2 wt % of water; and
(b) a liquid fuel.

In one embodiment the invention provides a composition comprising a dispersion of:

(a) a metal base selected from the group consisting of:
  (i) a metal hydroxide;
  (ii) a metal base other than a metal hydroxide; and
  (iii) mixtures thereof;
(b) a surfactant;
(c) a carboxylic acid; and
(d) an organic medium containing less than about 2 wt % of water, wherein said metal base is present in at a solids content greater than about 51 wt % of the composition when the base is a metal hydroxide and at a solids content of greater than 15 wt % when said metal base is other than a metal hydroxide or is a mixture, and wherein the composition is a grease.

In some embodiments the presence of mixtures of metal hydroxides and metal bases other than metal hydroxides only requires a solid content of greater than 15 wt. %, this is especially true if the metal base other than hydroxide is present in the major amount. In other embodiments the presence of any metal hydroxide (a mixture) with a metal base other than metal hydroxide will trigger the greater than 51 wt. % solids requirement, this is especially true when the metal hydroxide is present in the major amount of the two components. The dispersion of components (a)-(c) above, containing the metal base other than a metal hydroxide with a solids content greater than about 15 wt % of the composition, in another embodiment greater than about 35 wt % of the composition, in another embodiment greater than about 45 wt % of the composition, in another embodiment greater than about 48 wt % of the composition, in another embodiment greater than about 50 wt % of the composition, in another embodiment greater than about 52 wt % of the composition, in another embodiment greater than about 55 wt % of the composition and in yet another embodiment greater than about 60 wt % of the composition.

The dispersion when derived from a metal hydroxide has a solids content of greater than about 51 wt % of the composition, in another embodiment about 53 wt % of the composition, in another embodiment greater than about 55 wt % of the composition, and in yet another embodiment greater than about 58 wt % of the composition.

The solids content of the dispersion generally has no upper limit except the maximum amount that the organic medium containing less than about 2 wt % of water can hold and examples include up to about 90 wt % of the composition, in another embodiment about 86 wt % of the composition and in another embodiment about 84 wt % of the composition. Examples of suitable ranges include about 52 wt % to about 90 wt % of the composition, in another embodiment about 55 wt % to about 84 wt % of the composition and in yet another embodiment about 60 wt % to about 84 wt % of the composition. The amount of metal base present in the composition is determined by the desired solid content.

In one embodiment the composition is substantially free of an oil insoluble solvent. Examples of an oil insoluble solvent include water, alcohol or mixtures thereof. By substantially free the composition contains less than about 2 wt % of an oil insoluble solvent other than water of hydration or free water derived from water of hydration, in another embodiment less than about 1 wt % of an oil insoluble solvent other than water of hydration, and in yet another embodiment less than about 0.1 wt % of an oil insoluble solvent other than water of hydration.

The viscosity of the dispersion as measured by TA Instruments AR 500™ Rheometer using "cone on plate geometry" measured at about 40° C. at 100 $s^{-1}$ includes ranges from about 0.001 Pa s to about 20 Pa s, in another embodiment about 0.003 Pa s to about 5 Pa s, in another embodiment about 0.005 Pa s to about 2 Pa s and in yet another embodiment in another embodiment about 0.005 Pa s to about 1 Pa s.

Metal Base

The dispersion of the metal base is a mono- or di- or tri- or tetra-valent metal or a mixture thereof. In one embodiment the metal base is derived from a monovalent metal including lithium, potassium, sodium, copper, zinc, or mixtures thereof. In one embodiment the metal base is derived from a divalent metal including magnesium, calcium, barium or mixtures thereof. The metal may also have multiple valence e.g. mono- or di- or tri-valent with copper or iron as examples. In one embodiment the metal base is derived from a tetravalent metal including cerium. The metal base optionally contains water of hydration.

The metal base includes those in the form of $M_{1-2}(Q)_{1-3}.xH_2O$ or $M(Q)_{1-3}.xH_2O$, wherein M is a mono- or di- or tri- or tetra-valent metal ion; "1-3" means 1, 2, or 3 Q groups wherein Q includes a hydroxyl, a carbonate, an oxide, a sulphate, a carboxylate (examples include acetate, propionate, oxalate, citrate, succinate, or mixtures thereof), borate or phosphate or mixtures thereof; and x is a fraction in the range 0 to 8, in another embodiment 0 to about 4 and in yet another embodiment 0 to about 2. In one embodiment the metal base is a monohydrate, in another embodiment the metal base is a dihydrate and in yet another embodiment the metal base is anhydrous.

When x=1 the metal base is in the form of the monohydrate. When x is greater than zero and less than 1, the metal base is partially, substantially or wholly anhydrous. Partially anhydrous metal base includes ranges of x from about 0.9 to about 0.5, in another embodiment about 0.85 to about 0.55 and in another embodiment about 0.6 to about 0.7. Substantially anhydrous metal base includes x less than about 0.5, in another embodiment less than about 0.3, in another embodiment about 0.1 but greater than about 0.02. Wholly anhydrous metal base has x in the range about 0.02 to about 0, in another embodiment x is about 0.01 to about 0 and in another embodiment x is about 0.

In one embodiment the metal base is in the form of a solid and is not appreciably soluble in the organic medium containing less than about 2 wt % of water. In one embodiment the metal base has a mean particle size in the dispersion in the range of about 20 nanometers to about 40 micrometers, in another embodiment about 30 nanometers to about 20 micrometers, in another embodiment about 50 nanometers to about 15 micrometers and in yet another embodiment about 200 nanometers to about 8 micrometers.

Examples of suitable ranges include those with a mean particle size in the dispersion in the range of about 3 nanometers to about 5 micrometers, in another embodiment about 5 nanometers to about 2 micrometers, in another embodiment about 10 nanometers to about 1.5 micrometers, in another embodiment about 15 nanometers to about 1 micrometers, in another embodiment about 20 to about 600 nanometers, in another embodiment about 50 to about 550 nanometers and in yet another embodiment about 75 to about 500 nanometers.

Examples of a suitable metal base include sodium carbonate, sodium bicarbonate, potassium carbonate, potassium bicarbonate, anhydrous lithium hydroxide, lithium hydroxide monohydrate, magnesium hydroxide, calcium hydroxide, lithium carbonate, calcium carbonate, copper acetate, magnesium carbonate, calcium oxide, magnesium oxide, lithium oxide, cerium oxide, iron oxide or mixtures thereof. In one embodiment of the invention the metal base is present in a mixture, for instance dolmitic lime which is commercially available.

Surfactant

The surfactant includes an ionic (cationic or anionic) or non-ionic compound. Suitable surfactant compounds include those with a hydrophilic lipophilic balance (HLB) of up to about 20, in another embodiment about 1 to about 18, in another embodiment about 2 to about 16 and in yet another embodiment about 2.5 to about 15. In one embodiment the HLB includes about 11 to about 14 or in another embodiment less than about 10 such as about 1 to about 8, or about 2.5 to about 6. Those skilled in the art will appreciate that combinations of surfactants may be used with individual HLB values outside of these ranges, provided that the composition of a final surfactant blend is within these ranges. When the surfactant has an available acidic group, the surfactant may become the metal salt of the acidic group and where the metal is derived from the metal base. In one embodiment the surfactant is other than a fatty acid or derivatives thereof, such as esters. In one embodiment the surfactant is other than a fatty acid or derivatives thereof.

Examples of these surfactants suitable for the invention are disclosed in *McCutcheon's Emulsifiers and Detergents,* 1993, North American & International Edition. Generic examples include alkanolamides, alkylarylsulphonates, amine oxides, poly(oxyalkylene) compounds, including block copolymers comprising alkylene oxide repeat units (e.g., Pluronic™), carboxylated alcohol ethoxylates, ethoxylated alcohols, ethoxylated alkyl phenols, ethoxylated amines and amides, ethoxylated fatty acids, ethoxylated fatty esters and oils, fatty esters, glycerol esters, glycol esters, imidazoline derivatives, lecithin and derivatives, lignin and derivatives, monoglycerides and derivatives, olefin sulphonates, phosphate esters and derivatives, propoxylated and ethoxylated fatty acids or alcohols or alkyl phenols, sorbitan derivatives, sucrose esters and derivatives, sulphates or alcohols or ethoxylated alcohols or fatty esters, polyisobutylene succinicimide and derivatives, sulphonates of dodecyl and tridecyl benzenes or condensed naphthalenes or petroleum, sulphosuccinates and derivatives, and a hydrocarbyl substituted benzene sulphonic acid.

In one embodiment the surfactant is a hydrocarbyl substituted benzene sulphonic acid or sulphonate of an alkali metal, alkaline earth metal or mixtures thereof. The hydrocarbyl (especially an alkyl) group includes those with about 8 to about 30 carbon atoms, in another embodiment about 10 to about 26 carbon atoms and in another embodiment about 10 to about 15 carbon atoms. In one embodiment the surfactant is a mixture of $C_{12}$ to $C_{15}$ alkylbenzene sulphonic acids. The alkali metal includes lithium, potassium or sodium; and the alkaline earth metal includes calcium or magnesium. In one embodiment the alkali metal is sodium. In one embodiment the alkaline earth metal is calcium.

In one embodiment the surfactant is a derivative of a polyolefin. Typical examples of a polyolefin include polyisobutene; polypropylene; polyethylene; a copolymer derived from isobutene and butadiene; a copolymer derived from isobutene and isoprene; or mixtures thereof.

In one embodiment the polyolefin is a derivative of polyisobutene with a number average molecular weight of at least about 250, 300, 500, 600, 700, or 800, to 5000 or more, often up to about 3000, 2500, 1600, 1300, or 1200. Typically, less than about 5% by weight of the polyisobutylene used to make the derivative molecules have $\overline{Mn}$ less than about 250, more often the polyisobutylene used to make the derivative has $\overline{Mn}$ of at least about 800. The polyisobutylene used to make the derivative preferably contains at least about 30% terminal vinylidene groups, more often at least about 60% and more preferably at least about 75% or about 85% terminal vinylidene groups. The polyisobutylene used to make the derivative may have a polydispersity, $\overline{Mw}/\overline{Mn}$, greater than about 5, more often from about 6 to about 20.

In one embodiment, the polyisobutene is substituted with succinic anhydride, the polyisobutene substituent having a number average molecular weight of about 1,500 to about 3,000, in another embodiment about 1,800 to about 2,300, in another embodiment about 700 to about 1300, in another embodiment about 800 to about 1000, said first polyisobutene-substituted succinic anhydride being characterised by about 1.3 to about 2.5, and another embodiment about 1.7 to about 2.1. In one embodiment, the hydrocarbyl-substituted carboxylic acid acylating agent is a polyisobutene-substituted succinic anhydride, the polyisobutene substituent having a number average molecular weight of about 1,500 to about 3,000, and in another embodiment about 1,800 to about 2,300, said first polyisobutene-substituted succinic anhydride being characterised by about 1.3 to about 2.5, and in another embodiment about 1.7 to about 2.1, in another embodiment about 1.0 to about 1.3, and in yet another embodiment about 1.0 to about 1.2 succinic groups per equivalent weight of the polyisobutene substituent.

In one embodiment the surfactant has a molecular weight of less than about 1000, in another embodiment less than about 950, for example, about 250, about 300, about 500, about 600, about 700, or about 800.

In one embodiment the surfactant is polyisobutenyl-dihydro-2,5-furandione ester with pentaelythritol or mixtures thereof. In one embodiment the surfactant is a polyisobutylene succan derivative such as a polyisobutylene succinimide or derivatives thereof. In one embodiment the surfactant is substantially free to free of a basic nitrogen.

Other typical derivatives of polyisobutylene succans include hydrolysed succans, esters or diacids. Polyisobutylene succan derivatives are preferred to make the metal base dispersions. A large group of polyisobutylene succan derivatives are taught in U.S. Pat. No. 4,708,753, U.S. Pat. No. 4,234,435 and herein incorporated by reference.

The amount of the surfactant to form the metal base dispersion includes about 0.01 wt % to about 60 wt % of the composition, in another embodiment about 0.05 wt % to about 35 wt % of the composition, in another embodiment about 0.1 wt % to about 30 wt % of the composition and in yet another embodiment about 0.2 wt % to about 25 wt % of the composition.

Organic Medium Containing Less Than About 2 wt % of Water

The organic medium containing less than about 2 wt % of water includes an oil of lubricating viscosity, a liquid fuel, a hydrocarbon solvent or mixtures thereof. In one embodiment the organic medium containing less than about 2 wt % of water is an oil of lubricating viscosity and in another embodiment the hydrocarbon solvent. In one embodiment the organic medium contains less than about 1 wt % water, in another embodiment less than about 0.5 and in another embodiment less than about 0.1 wt % of water.

The organic medium containing less than about 2 wt % of water is present in ranges including up to about 85 wt % of the composition, in another embodiment up to about 75 wt % of the composition, in another embodiment up to about 60 wt % of the composition and in yet another embodiment up to about 40 wt % of the composition. In one embodiment of the invention the organic medium containing less than about 2 wt % of water is present from about 60 wt % to about 90 wt % of the composition.

Oil of Lubricating Viscosity

The lubricating oil composition includes natural or synthetic oils of lubricating viscosity, oil derived from hydrocracking, hydrogenation, hydrofinishing, unrefined, refined and re-refined oils or mixtures thereof.

Natural oils include animal oils, vegetable oils, mineral oils or mixtures thereof. Synthetic oils include a hydrocarbon oil, a silicon-based oil, a liquid ester of phosphorus-containing acid. Synthetic oils may be produced by Fischer-Tropsch reactions and typically may be hydroisomerised Fischer-Tropsch hydrocarbons or waxes.

Oils of lubricating viscosity may also be defined as specified in the American Petroleum Institute (API) Base Oil Interchangeability Guidelines. In one embodiment the oil of lubricating viscosity comprises an API Group I, II, III, IV, V or mixtures thereof, and in another embodiment API Group I, II, III or mixtures thereof. If the oil of lubricating viscosity is an API Group II, III, IV or V oil there may be up to about 40 wt % and in another embodiment up to a maximum of about 5 wt % of the lubricating oil an API Group I oil.

Liquid Fuel

The fuel composition of the present invention comprises a liquid fuel and is useful in fueling an internal combustion engine or open flame combustion system. The liquid fuel is normally a liquid at ambient conditions. The liquid fuel includes a hydrocarbon fuel, a nonhydrocarbon fuel, or a mixture thereof. The hydrocarbon fuel may be a petroleum distillate to include a gasoline as defined by ASTM (American Society for Testing and Materials) specification D4814 or a diesel fuel as defined by ASTM specification D975. In an embodiment of the invention the liquid fuel is a gasoline, and in another embodiment the liquid fuel is a leaded gasoline, or a nonleaded gasoline. In another embodiment of this invention the liquid fuel is a diesel fuel. The hydrocarbon fuel includes a hydrocarbon prepared by a gas to liquid process for example hydrocarbons prepared by a process such as the Fischer-Tropsch process. The nonhydrocarbon fuel includes an oxygen containing composition (often referred to as an oxygenate), an alcohol, an ether, a ketone, an ester of a carboxylic acid, a nitroalkane, or a mixture thereof. The nonhydrocarbon fuel includes methanol, ethanol, methyl t-butyl ether, methyl ethyl ketone, transesterified oils and/or fats from plants and animals such as rapeseed methyl ester and soybean methyl ester, and nitromethane. Mixtures of hydrocarbon and nonhydrocarbon fuels include gasoline and methanol and/or ethanol, diesel fuel and ethanol, and diesel fuel and a transesterified plant oil such as rapeseed methyl ester. In an embodiment of the invention the liquid fuel is a nonhydrocarbon fuel, or a mixture thereof.

Carboxylic Acid

The composition of the invention optionally includes a carboxylic acid especially containing about 2 to about 30 carbon atoms, wherein the carboxylic acid is selected from a monocarboxylic acid, a polycarboxylic acid and mixtures thereof, and optionally the carboxylic acid is further substituted with groups selected from a hydroxyl group, an ester and mixtures thereof. In one embodiment the composition includes a carboxylic acid. In another embodiment the composition does not contain a carboxylic acid. When present the carboxylic acid is used as a thickener in the manufacture of a grease.

In one embodiment the carboxylic acid may also be used with other known thickening agents such as inorganic powders including clay, organo-clays, bentonite, fumed silica, calcite, carbon black, pigments, copper phthalocyanine or mixtures thereof.

The carboxylic acid may be any combination of a mono- or poly-carboxylic; branched alicyclic, or linear, saturated or unsaturated, mono- or poly-hydroxy substituted or unsubstituted carboxylic acid, acid chloride or the ester of said carboxylic acid with an alcohol such as an alcohol of about 1 to about 5 carbon atoms. The carboxylic acid includes those with about 2 to about 30 carbon atoms, in another embodiment about 4 to about 30 carbon atoms, in another embodiment about 8 to about 27 carbon atoms, in another embodiment about 12 to about 24 carbon atoms and in yet another embodiment about 16 to about 20 carbon atoms. In one embodiment the carboxylic acid is a monocarboxylic acid or mixtures thereof. In one embodiment the carboxylic acid is a dicarboxylic acid or mixtures thereof. In one embodiment the carboxylic acid is an alkanoic acid. In one embodiment the carboxylic acid is a mixture of dicarboxylic acid and monocarboxylic acid typically in the weight percent ratio of about 99:1, 70:30, 50:50, 40:60, 35:65, 30:70, 25:75, 20:80, 15:85, 10:90, 5:95 or 1:99. Dicarboxylic acid compounds tend to be more expensive than a monocarboxylic acid and as a consequence, most industrial processes using mixtures use a ratio of dicarboxylic acid to monocarboxylic acid in the range about 30:70 or about 25:75 to about 20:80 or about 15:85.

In one embodiment the carboxylic acid is hydroxy substituted or an unsubstituted alkanoic acid. Typically, the carboxylic acids will have about 2 to about 30, in another embodiment about 4 to about 30, in another embodiment about 12 to about 24 and in yet another embodiment about 16 to about 20 carbon atoms. In one embodiment the carboxylic acid is a hydroxystearic acid or esters of these acids such as 9-hydroxy, 10-hydroxy or 12-hydroxy, stearic acid, and especially 12-hydroxy stearic acid. The monocarboxylic acid having this number of carbon atoms are generally associated with an HLB (hydrophile to lipophile balance) of about 10 or more, in another embodiment about 12 or more and in another embodiment about 15 or more when converted to their salt form.

Other suitable saturated carboxylic acid compounds include capric acid, lauric acid, myristic acid, palmitic acid, arachidic acid, behenic acid, lignoceric acid or mixtures thereof.

Examples of suitable unsaturated carboxylic acid compounds include undecylenic acid, myristoleic acid, palmitoleic acid, oleic acid, gadoleic acid, elaidic acid, cis-eicosenoic acid, erucic acid, nervonic acid, 2,4-hexadienoic acid, linoleic acid, 12-hydroxy tetradecanoic acid, 10-hydroxy tetradeconoic acid, 12-hydroxy hexadecanoic acid, 8-hydroxy hexadecanoic acid, 12-hydroxy icosanic acid, 16-hydroxy icosanic acid 11,14-eicosadienoic acid, linolenic acid, cis-8,11,14-eicosatrienoic acid, arachidonic acid, cis-5,8,11,14,17-eicosapentenoic acid, cis-4,7,10,13,16,19-docosahexenoic acid, all-trans-retinoic acid, ricinoleic acid lauroleic acid, eleostearic acid, licanic acid, citronelic acid, nervonic acid, abietic acid, and abscisic acid. Most preferred acids are palmitoleic acid, oleic acid, linoleic acid, linolenic acid, licanic acid, eleostearic acid or mixtures thereof.

The polycarboxylic acid, especially dicarboxylic acids is present in a complex grease and suitable examples include iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid or mixtures thereof. In one embodiment the polycarboxylic acid is nonanedioic acid (azelaic acid) or mixtures thereof. In one embodiment the polycarboxylic acid is decanedioic acid (sebacic acid) or mixtures thereof.

The amount of carboxylic acid present in the invention includes those in the range from about 0 wt % to about 30 wt %, in another embodiment about 0.1 wt % to about 25 wt %, in another embodiment about 0.5 wt % to about 20 wt %, in another embodiment about 1 wt % to about 17 wt %, and in yet another embodiment about 3 wt % to about 13 wt % of the grease composition.

Other Performance Additive

When the composition of the invention contains the carboxylic acid (i.e. forms a grease), the composition optionally further includes at least one other performance additive. The other performance additive compounds include a metal deactivator, a detergent, a dispersant, an antiwear agent, an antioxidant, a corrosion inhibitor, a foam inhibitor, a demulsifiers, a pour point depressant, a seal swelling agent or mixtures thereof.

The total combined amount of the other performance additive compounds present on an oil free basis in ranges from about 0 wt % to about 25 wt %, in another embodiment about 0.01 wt % to about 20 wt %, in another embodiment about 0.04 wt % to about 15 wt % and in yet another embodiment about 0.06 wt % to about 10 wt % of the composition. Although one or more of the other performance additives may be present, it is common for the other performance additives to be present in different amounts relative to each other.

Process

The invention further provides a process for preparing a composition comprising the steps of:

(1) mixing (a) a metal base; (b) a surfactant and (c) a organic medium containing less than about 2 wt % of water to form a slurry:

(2) grinding the slurry of step (1) to form a dispersion;

(3) optionally heating the dispersion of step (2) to a temperature to about 40° C. to about 190° C. to form a finer dispersion;

(4) optionally reacting the dispersion of steps (2) or (3) with a carboxylic acid containing about 2 to about 30 carbon atoms, wherein the carboxylic acid is a monocarboxylic acid, a polycarboxylic acid or mixtures thereof, and optionally the carboxylic acid is further substituted with groups selected from a hydroxyl group, an ester and mixtures thereof.

In one embodiment the composition of the invention is obtainable by the process defined above. In one embodiment the process defined above is capable of preparing a dispersion with a metal base selected from the group consisting of: (i) a metal hydroxide with a solids content of greater than about 51 wt % of the composition; (ii) a metal base other than a metal hydroxide with a solids content of greater than about 15 wt % of the composition; and (iii) mixtures thereof Generally the process of the invention is capable of preparing a dispersion with a solids content from about 1 wt % to about 90 wt %, in another embodiment about 15 wt % to about 86 wt %, in another embodiment about 15 wt % to about 84 wt an in yet another embodiment about 35 wt % to about 70 wt %.

Components (a)-(c) often form a dispersion before the optional addition of the carboxylic acid. Components (a)-(c) in step (1) are mixed sequentially and/or separately to form the slurry. The mixing conditions include for a period of time in the range about 30 seconds to about 48 hours, in another embodiment about 2 minutes to about 24 hours, in another embodiment about 5 minutes to about 16 hours and in yet another embodiment about 10 minutes to about 5 hours; and at pressures in the range including about 86 kPa to about 500 kPa (about 650 mm Hg to about 3750 mm Hg), in another embodiment about 86 kPa to about 266 kPa (about 650 mm Hg to about 2000 mm Hg), in another embodiment about 91 kPa to about 200 kPa (about 690 mm Hg to about 1500 mm Hg), and in yet another embodiment about 95 kPa to about 133 kPa (about 715 mm Hg to about 1000 mm Hg); and at a temperature including about 15° C. to about 70° C., and in another embodiment about 25° C. to about 70° C. In one embodiment the process does not require a free fatty acid such as oleic acid, naphthenic acid or a 50/50 mixture of said free fatty acid to be added to prior to grinding.

In step (2) the grinding includes any type of reduction of particle size of the metal base by mechanical means. The grinding typically produces enough shear to break agglomerates of the metal base, aggregates of the metal base, solid particles of the metal base or mixtures thereof. The grinding typically produces heat and therefore as a result it is desirable to control the heating by using cooling equipment.

Examples of suitable grinding procedure include a rotor stator mixer, a vertical bead mill, a horizontal bead mill, basket milling, baw mill, pearl milling or mixtures thereof. In one embodiment the grinding procedure is the use of the vertical bead mill and in another embodiment the horizontal bead mill. Either bead mill processes cause the reduction of particle size of the metal base by high energy collisions of the metal base with at least one bead; and/or other metal base agglomerates, aggregates, solid particles; or mixtures thereof. The beads typically have a mean particle size greater than the desired mean particle size of the metal base. In some instances the beads are a mixture of different mean particle size.

The mill typically contains beads present at least about 40 vol % of the mill, in another embodiment at least about 60 vol % of the mill for example 60 vol % to 74.9 vol % and in yet another embodiment at least about 70 vol % of the mill, for example, 75 vol % to about 85 vol %.

Optional step (3) may be performed if the grinding step produces a metal base with a mean particle size above about 0.3 micrometers, in another embodiment about 1 micrometer, in another embodiment above about 3 micrometers, in another embodiment above about 4 micrometers, in another embodiment above about 5 micrometers and in yet another embodiment above about 6 micrometers.

The heating temperature of step (3) includes about 40° C. to about 190° C., in another embodiment about 45° C. to about 140° C., in another embodiment about 50° C. to about 110° C. and in yet another embodiment about 60° C. to about 102° C. Optionally, step (3) further includes grinding during and/or after heating.

Optional step (4) is well known and includes all known process of preparing a grease. Examples of suitable reaction temperatures used include about 80° C. to about 250° C., in another embodiment about 80° C. to about 240° C., in another embodiment about 90 to about 210° C., in another embodiment about 110° C. to about 190° C. and in yet another embodiment 120° C. to about 170° C. In one embodiment the reaction temperature is in the range of about 90° C. to about 240° C. In one embodiment the reaction temperature is in the range of about 110° C. to about 230° C. In one embodiment the reaction temperature is in the range of about 120° C. to about 225° C.

The process optionally includes mixing other optional performance additives as described above. The optional performance additives may be added sequentially, separately or as a concentrate.

Said process of producing a grease composition wherein the process includes either a batch, semi continuous, continuous or a non-batch process. In one embodiment the grease composition is prepared using non-batch and in another embodiment by a semi continuous processes.

INDUSTRIAL APPLICATION

The composition of the present invention is useful in manufacture of grease. Examples of suitable grease include a lithium soap grease made with a monocarboxylic acid, a complex soap grease, a lithium complex soap grease, a calcium soap grease, a low noise soap grease are (sometimes characterised by the lack of residual metal base particles above about 2 micrometers in diameter); a short fibre high soap content grease or mixtures thereof. In one embodiment the grease includes a lithium soap grease, in another embodiment a complex soap grease, in another embodiment a lithium complex soap grease, in another embodiment a low noise soap grease and in yet another embodiment a short fibre high soap content grease.

The low noise grease is known and typically used in rolling element bearing applications such as pumps or compressors. The complex soap grease is known and include smooth or show grain. Furthermore, the complex grease contains a polycarboxylic acid typically a dicarboxylic acid. The short fibre high soap content grease is known and is often used in specialist applications.

In one embodiment the composition is a liquid fuel. The composition may impart at least one property to a liquid fuel including viscosity control, control of sulphur oxide emissions, combustion improvement, control of particulate matter formation and reduction in the formation of vanadium containing ash deposits which forms catastrophically, corrosive low-melt slag.

When the composition of the invention is applied in an industrial application it is present in the ranges including about 0.01 to about 40 wt %, in another embodiment about 0.1 to about 30 wt % and in yet another embodiment about 0.5 to about 20 wt %.

The following examples provide an illustration of the invention. These examples are non exhaustive and are not intended to limit the scope of the invention.

EXAMPLES

Examples 1 to 19

A series of dispersions containing a metal base, an organic medium and a surfactant were prepared from a slurry weighing about 300 g. The dispersions were prepared by grinding the slurry using a vertical bead mill for about 1.5 to 8 hours or until the metal base was sub-micron (i.e. ≦1 μm). The resulting dispersion mean particle size was determined after cooling by Coulter® LS230 Particle Size Analyser. Alternatively, the largest particle size was determined using a standard optical microscope with a ×400 magnification and a calibrated graticule. The amount of metal base, organic medium and surfactant present in the dispersions are presented in Table 1 and particle size analysis is presented in Table 2.

Example 2 was prepared by a similar process except the grinding procedure was carried out until the metal base had a mean particle size of about 6.55 μm. The dispersion was then heated to about 90° C. for about 3 hours.

Examples 7 and 8 were prepared by a similar process as described above except, dispersion was prepared by grinding the slurry using an industrial scale horizontal bead mill to prepare a 46 kg dispersion. The bead mill had a rotor tip speed varied between about 5-20 $ms^{-1}$.

Three kilograms of Example 15 was prepared by a similar process as described above except, using a lab scale Dyno-Mill ECM Multi-Lab horizontal bead mill commercially available from W.A.B. A.G., Basel with a rotor tip speed of 8 $m/s^{-1}$.

TABLE 1

| | Metal Base | | Surfactant | | | Organic Medium | |
|---|---|---|---|---|---|---|---|
| EX | Name/ Formula | Solids Content (%) | Name | Amount Present on oil free basis (%) | | Name | Amount Present (%) |
| 1 | $LiOH•H_2O$ | 22.4 | Furandione | 9.6 | | GP II | 68 |
| 2 | $LiOH•H_2O$ | 22.4 | Furandione | 9.6 | | GP II | 68 |
| 3 | $LiOH•H_2O$ | 22.4 | PIBSA 851-1600 | 13.1 | | 330SN | 64.5 |
| 4 | $LiOH•H_2O$ | 60 | sulphonic acid | 5.9 | | PAO-6 | 34.1 |
| 5 | $Li_2CO_3$ | 33.7 | Furandione | 8.2 | | GP II | 58.1 |
| 6 | CaO | 60 | sulphonic acid | 4.6 | | GP II | 35.4 |
| 7 | $Ca(OH)_2$ | 50 | sulphonic acid | 11.6 | | GP II | 38.4 |
| 8 | MgO | 50 | PIBSA glycol | 7.3 | | PN | 42.6 |
| 9 | MgO | 50 | PIBSA glycol | 3.7 | | PN | 46.3 |
| 10 | Cerium Oxide | 20 | PIBSA glycol | 0.3 | | PN | 79.7 |
| 11 | $Fe_2O_3$ | 20 | PIBSA Glycol | 0.3 | | PN | 79.7 |
| 12 | $Na_2CO_3$ | 50 | Furandione | 10 | | PN | 40 |
| 13 | $H_2NaCO_3$ | 50 | PIBSA 851-1600 | 10 | | PN | 40 |
| 14 | Cerium Oxide | 50 | Furandione | 10 | | PN | 40 |
| 15 | $Fe_2O_3$ | 70 | sulphonic acid | 12 | | GP II | 18 |
| 16 | $CaCO_3$ | 50 | sulphonic acid | 5 | | GP II | 45 |

TABLE 1-continued

| Metal Base | | Surfactant | | | Organic Medium | |
|---|---|---|---|---|---|---|
| EX | Name/ Formula | Solids Content (%) | Name | Amount Present on oil free basis (%) | Name | Amount Present (%) |
| 17 | CaO | 60 | sulphonic acid | 6 | GP II | 34 |
| 18 | MgO | 63 | sulphonic acid | 4 | PN | 33 |
| 19 | $Fe_2O_3$ | 70 | sulphonic acid | 2 | PN | 28 |

Footnote to Table 1

PN refers to a petroleum naphtha organic medium;

GP II refers to an API Group II 100SN base oil;

330SN refers to a 330SN base oil;

Furandione refers to a polyisobutenyl-dihydro-2,5-furandione ester with pentaerythritol surfactant;

PIBSA 851-1600 refers to a polyisobutylene succinic acid with a molecular weight in the range 851-1600 surfactant;

PIBSA glycol refers to polyisobutylene succinic acid reacted with ethylene glycol and 2-(dimethylamine)ethanol surfactant;

Sulphonic acid refers to $C_{12}$-$C_{15}$ alkyl benzene sulphonic acid surfactant;

the viscosity of example 6 is about 0.5 Pa $s^{-1}$ at 40° C. at a shear rate of 100 $s^{-1}$; and the viscosity of example 9 is about 0.05 Pa $s^{-1}$ at 40° C. at a shear rate of 100 $s^{-1}$.

TABLE 2

| Example | Particle Size (μm) |
|---|---|
| 1 | Mean, 0.18 |
| 2 | Mean, 0.51 |
| 3 | Mean, 5.5 |
| 4 | Mean, 6.3 |
| 5 | Mean, 2.0 |
| 6 | Mean, 1.5 |
| 7 | Mean, 0.25 |
| 8 | Mean, 0.24 |
| 9 | Mean, 1.19 |
| 10 | Largest, 2.0 |
| 11 | Largest, 3.0 |
| 12 | Largest, 1.0 |
| 13 | Largest, 1.5 |
| 14 | Largest, 2.0 |
| 15 | Mean, 0.36 |
| 16 | Mean, 1.80 |
| 17 | Mean, 1.50 |
| 18 | Largest, 5.0 |
| 19 | Largest, 2.0 |

Examples 20-26

Magnesium Oxide Dispersions

A series of magnesium oxide dispersions was prepared in a vessel using a high torque stirrer (commercially available from Stuart Scientific) capable of maintaining a stirring rate of about 200-300 rpm. The stirrer was fitted with a polypropylene or polyurethane 'U'-shaped stirring paddle. The vessel further contained about 700 g of beads (3.4-4.3 mm Ø). The contents of the vessel were stirred for about 8 hours and about 7.8%(on oil free basis) of a polyisobutylene succinic acid reacted with 1,2-ethane diol and salted with two moles of 2-dimethylaminoethanol surfactant with a molecular weight in the range 1000-2300. The results obtained were:

TABLE 3

| Example | % of MgO | Organic Medium | Mean Particle Size (μm) |
|---|---|---|---|
| 20 | 48.3 | Petroleum Naphtha | 1.21 |
| 21 | 49.3 | Aliphatic Petroleum Naphtha | 1.22 |
| 22 | 49.4 | Petroleum naphtha + trimethylbenzene | 1.74 |
| 23 | 49.1 | 100SN base oil | 2.08 |
| 24 | 49.5 | Petroleum Naphtha C9-16 De-aromatised | 1.19 |
| 25 | 48.8 | Heavy aromatic petroleum distillate | 1.20 |
| 26 | 49.1 | ULSD Diesel Fuel | 1.72 |

Examples 27 to 36

Different Magnesium Grades

The process is the same as Examples 20 to 26, except the MgO is present at 19.3%, petroleum naptha is present at about 76.8% and surfactant is present at about 3.9% (on an oil free basis). The results obtained were:

TABLE 4

| Example | MgO Product Name | BET N2 Surface Area ($m^2 g^{-1}$) | Bulk Denisty ($g/cm^3$) | Largest Particle size (μm) |
|---|---|---|---|---|
| 27 | MagChem40 | 45 | 0.45-0.7 | 3 |
| 28 | SIG | — | — | 2 |
| 29 | KPLL-80 | | 0.61 | 4 |
| 30 | KPLL-60 | 65 | 0.35 | 2 |
| 31 | KPLL-20 | 25 | 0.45 | 2 |
| 32 | KP-JM | — | — | 3 |
| 33 | KP-3083 | 3.5 | 0.61 | 4 |
| 34 | E-4 | 66 | 0.41 | 2 |
| 35 | E-10 Grade | 187 | 0.45 | 3 |
| 36 | E-10 | 113 | 0.38 | 2 |

Footnote to Table 4

The magnesium oxide employed example 27 is commercially available from Martin Marietta;

The magnesium oxide employed in all examples 28 to 36 are commercially available from Dead Sea Periclase;

Examples 37 to 47

Different Surfactants

The process is the same as example 28, except the surfactant is a polyisobutylene with varied head group and molecular weight of the tail; and the milling is carried out for about 1.5 hours. The results obtained were:

TABLE 5

| Polyisobutylene Surfactant | | | |
|---|---|---|---|
| Example | Head group | Molecular weight of tail | Largest Particle size (μm) |
| 37 | Dimethylethanol amine salt | 324 | 2 |
| 38 | Pentaerythritol ester | 1000 | 5 |
| 39 | Polyethyleneamine (60% actives) | 1000 | 3 |
| 40 | Polyethyleneamine (74% actives) | 1000 | 3 |
| 41 | Thiophosphate barium salt | 1000 | 1.5 |
| 42 | Glycol ester and Dimethylethanol amine salt | 1550 | 2 |
| 43 | Polyethyleneamine (62% actives) | 2000 | 4 |

TABLE 5-continued

| Example | Polyisobutylene Surfactant Head group | Molecular weight of tail | Largest Particle size (μm) |
|---|---|---|---|
| 44 | Polyethyleneamine (50% actives) | 2000 | 2 |
| 45 | Succinic acid | 2300 | 3 |
| 46 | Polyethyleneamine (50% actives) | 2300 | 3 |
| 47 | Succinic anhydride | 2300 | 2 |

Examples 48 to 54

Alkyl Benzene Sulphonic Acid

The process is the same as example 29, except the surfactant is a $C_{12}$-$C_{15}$ alkyl benzene sulphonic acid as defined in Table 4; and the milling is carried out for about 1.5 hours. The results obtained were:

TABLE 6

| Example | $C_{12}$-$C_{15}$ Alkyl Benzene Sulphonic Acid Surfactant Head Group | Alkyl Molecular Weight | Largest Particle size (μm) |
|---|---|---|---|
| 48 | (calcium overbased to 300 TBN) | 566 | 4 |
| 49 | Non-overbased calcium alkyl chain $C_{22}$ to $C_{32}$ | 310-449 | 4 |
| 50 | Barium sulphonate with TBN 156 | 250 | 4 |
| 51 | Sulphonic Acid | 630 | 3 |
| 52 | Sulphonic Acid | | 7 |
| 53 | Sulphonic Acid | 345 | 8 |
| 54 | Suiphonic Acid | 345 | 5 |

Example 55

Particle Size Less Than 100 nm

Example is prepared by blending magnesium oxide wt % by weight with 10 wt % on an oil free basis of polyisobutylene succinic acid with a molecular weight in the range 851-1600 surfactant; and an oil of lubricating viscosity. This was first milled in an ECM Multilab Dyno Mill (supplied by WAB AG, Basle). The mill is charged with 0.3 mm Ø zirconia/yttria beads and operated with a tip speed of 8 m/s. After a residence time of 10 minutes, a 100% sub micron (mean size 298 nm) dispersion is obtained. This dispersion (A) has a dynamic viscosity of 200 cP at a shear rate of 250 $s^{-1}$. Dispersion (A) is further milled in an NPM Pilot Dyno Mill (supplied by WAB AG, Basle). The mill is charged with 0.05 mm Ø zirconia/yttria beads. After a residence time of 10 minutes, a dispersion is obtained with a mean size below 100 nm. The viscosity of the dispersion was below 400 cP at 250 $s^{-1}$.

Comparative Example

The process is the same as Example 28 except the surfactant is 12-hydroxystearic acid. However, the sample viscosity increased to such an extent that the agitation speed was reduced. The final product largest particle size as determined by microscopy was about 7 μm in diameter.

Dispersion Stability Test

Dispersion are stored in sealed glass tubes in a dark room at ambient temperature and 60° C. for four weeks. The results obtained from the four week dispersion stability test performed on Examples 27-51 and 54 indicate that no significant solvent layer or sediment layer formed. Examples 52 and 53 show some separation of solvent and a sediment layer. The performance of examples 52 and 53 is believed to be due to the initial excessively large particle size of the magnesium oxide.

Test on Interaction of Fortuitous Water Contamination

Dispersion of magnesium oxide prepared in similar processes to Examples 23-26 are contacted with 3 g of water per 97 g of dispersion. The dispersions containing water are mixed and then placed in an oven at 60° C. and at ambient temperature. After one week the dispersions form a top layer of water and the dispersion does not show signs of gel formation.

Grease Example 1

Preparation of Grease

A grease was prepared by mixing in a vessel containing about 9.8 wt % of 12-hydroxystearic acid into about 83.8 wt % of 600N base oil and heating to about 80° C. to melt the 12-hydroxystearic acid. The vessel and contents were cooled to about 50° C. before adding about 6.4 wt % of the product of Example 3. The vessel contents were then stirred forming a grease like material. The grease like material was then heated to about 150° C. and held for about 1 hour. The grease was then cooled to about 120° C.

Grease Example 2

Preparation of Grease with NLGI Consistency of 1

The process is the same as Example 12, except the grease is then milled through a triple roller. The resultant grease had a dropping point of 203° C.

Grease Example 3

Preparation of Grease with NLGI Consistency of 2-3

The process is the same as Example 13, except the grease like material was heated to about 195° C. instead of 150° C. The resultant grease had a dropping point of 204° C.

Fuel Examples 1 to 63

A series of fuel compositions are prepared by mixing examples 20 to 51 in middle distillate (Fuel Examples 1 to 31) and a heavy fuel oil (Fuel Examples 32 to 63) respectively. The fuel compositions have a metal content of about 1200 ppm. The fuel compositions are stored in sealed glass tubes in a dark room at ambient temperature and 60° C. for up to 3 months. The appearance of the fuel compositions are studied after 24 hours for the middle distillate and after 3 months for heavy fuel oil. The fuel compositions containing the dispersion of the invention are free of precipitate and/or other phase separation.

Fuel Examples 64 to 85

A series of examples are prepared by a similar process to Fuel Examples 1 to 69, except the dispersion examples are from examples 8-11, 14-15 and 18-19 in middle distillate (Fuel Examples 64 to 71) and a heavy fuel oil (Fuel Examples 72 to 79) respectively.

Combustion Improver in Open Flame Application Test

A 50 wt % calcium hydroxide dispersion is injected at 150 ppm into a 6 megawatt (MW) boiler employing a heavy fuel oil at constant fuel flow rate. Measurements of carbon monoxide, $NO_x$ and particulate matter. In the presence of the dispersion, the particulate matter formed is 58 mg/m$^3$.

The test in the absence of the dispersion produces 90 mg/m$^3$ of particulate matter.

A magnesium oxide dispersion similar to Examples 26 to 36 is treated at 925 ppm into a 200 megawatt open flame burner. The particulate matter formed is measured, along with $SO_3$ emissions using a LAND Conserver IV Model 220 Dew Point meter; and flue gas temperature. The data obtained by employing the magnesium oxide dispersion are shown in Table 7. Data obtained in the presence of the magnesium oxide dispersion are collected 40 hours after initial injection.

TABLE 7

| | Presence of 925 ppm of Magnesium Oxide | |
|---|---|---|
| Parameter Measured | Yes | No |
| Particulate Matter (mg/m$^3$) | 77 | 140 |
| $SO_3$ emissions (ppm) | 0 | 10 |
| Flue Gas Temperature (° C.) | 154 | 145 |

In general the fuel examples employing a calcium or magnesium dispersion demonstrate the a liquid fuel containing the dispersion of the invention may impart at least one property to a liquid fuel including viscosity control, control of sulphur oxide emissions, combustion improvement, control of particulate matter formation and reduction in the formation of vanadium containing ash deposits which forms catastrophically, corrosive low-melt slag.

While the invention has been explained, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition comprising a dispersion of:

(a) a metal base with mean particle size ranging from 15 nanometers to about 1 micrometers, wherein the metal base is selected from the group consisting of:
  (i) a metal hydroxide;
  (ii) a metal base other than a metal hydroxide; and
  (iii) mixtures thereof, wherein the metal hydroxide or the metal base contains a metal selected from the group consisting of lithium, potassium, sodium, copper, zinc, magnesium, calcium, barium, iron, cerium, and mixtures thereof, (b) a surfactant with a hydrophilic lipophilic balance (HLB) of about 2 to about 16; and (c) an organic medium containing less than about 2 wt % of water wherein said metal base is present at a solids content greater than about 51 wt % of the composition when said metal base is a metal hydroxide, and at a solids content of greater than about 35 wt % when said metal base is other than a metal hydroxide, or is a mixture, wherein the dispersion viscosity as measured by TA Instruments AR 500™ Rheometer using "cone on plate geometry" measured at about 40° C. at 100 s$^{-1}$ ranges from about 0.003 Pa s to about 5 Pa s.

2. The composition of claim 1, further comprising a carboxylic acid containing about 2 to about 30 carbon atoms, wherein the carboxylic acid is selected from a monocarboxylic acid, a polycarboxylic acid and mixtures thereof, and optionally the carboxylic acid is further substituted with groups selected from a hydroxyl group, an ester and mixtures thereof.

3. The composition of claim 1, wherein the metal base is anhydrous lithium hydroxide, lithium hydroxide monohydrate, magnesium hydroxide, calcium hydroxide, lithium carbonate, calcium carbonate, copper acetate, magnesium carbonate, calcium oxide, magnesium oxide, lithium oxide, cerium oxide, iron oxide or mixtures thereof.

4. The composition of claim 1, wherein the organic medium containing less than about 2 wt % of water is an oil of lubricating viscosity, a liquid fuel, a hydrocarbon solvent or mixtures thereof.

5. A process for preparing a composition comprising the steps of:

(1) mixing (a) a metal base, wherein the metal base contains a metal selected from the group consisting of lithium, potassium, sodium, copper, zinc, magnesium, calcium, barium, iron, cerium, and mixtures thereof; (b) a surfactant with a hydrophilic lipophilic balance (HLB) of about 2 to about 16, and (c) an organic medium containing less than about 2 wt % of water to form a slurry:

(2) grinding the slurry of step (1) to form a dispersion;

(3) optionally heating the dispersion of step (2) to a temperature to about 40° C. to about 190° C. to form a dispersion;

(4) optionally reacting the dispersion of steps (2)-(3) with a carboxylic acid containing about 2 to about 30 carbon atoms, wherein the carboxylic acid is a monocarboxylic acid, a polycarboxylic acid or mixtures thereof, and optionally the carboxylic acid is further substituted with groups selected from a hydroxyl group, an ester and mixtures thereof, wherein said metal base is present at a solids content greater than about 51 wt % of the composition when said metal base is a metal hydroxide and at a solids content of greater than about 35 wt % when said metal base is other than a metal hydroxide or is a mixture; and wherein the metal base of the composition has a mean particle size ranging from 15 nanometers to about 1 micrometers, wherein the dispersion viscosity as measured by TA Instruments AR 500™ Rheometer using "cone on plate geometry" measured at about 40° C. at 100 s$^{-1}$ ranges from about 0.003 Pa s to about 5 Pa s.

6. The process of claim 5, wherein grinding procedure is by a rotor stator mixer, a vertical bead mill, a horizontal bead mill, basket milling, pearl milling or mixtures thereof.

7. The process of claim 5, further comprising heating the dispersion of step (2) to a temperature to about 40° C. to about 190° C. to form a finer dispersion.

8. A fuel composition comprising:

(a) a dispersion comprising:
  (i) a surfactant other than a fatty acid or derivatives thereof, wherein the surfactant has a hydrophilic lipophilic balance (HLB) of about 2 to about 16;
  (ii) a metal base with a solids content of greater than about 35 wt % of the dispersion, wherein the metal base has a mean particle size ranging from 15 nanometers to about 1 micrometers, wherein the metal base contains a metal selected from the group consisting of lithium, potassium, sodium, copper, zinc, magnesium, calcium, barium, iron, cerium, and mixtures thereof; and (iii) an organic medium containing less than about 2 wt % of water;

wherein the dispersion viscosity as measured by TA Instruments AR 500™ Rheometer using "cone on plate geometry" measured at about 40° C. at 100 $s^{-1}$ ranges from about 0.003 Pa s to about 5 Pa s; and (b) a liquid fuel.

9. The fuel composition of claim 8, wherein the surfactant is a derivative of a polyolefin, a hydrocarbyl substituted benzene sulphonic acid or sulphonate of an alkali metal, alkaline earth metal or mixtures thereof.

10. The fuel composition of claim 9, wherein the surfactant has a molecular weight of less than about 1000.

11. The fuel composition of claim 8, wherein the metal base is magnesium carbonate, magnesium hydroxide or magnesium oxide.

12. The fuel composition of claim 8 further comprising a demulsifier.

13. The composition of claim 1, wherein the dispersion viscosity as measured by TA Instruments AR 500™ Rheometer using "cone on plate geometry" measured at about 40° C. at 100 $s^{-1}$ ranges from about 0.005 Pa s to about 2 Pa s.

14. The process of claim 5, wherein the dispersion has a solids content of about 55 wt % to about 84 wt %.

15. The composition of claim 1, wherein the composition is substantially free of an oil insoluble solvent.

16. A process according to claim 5, wherein said optional step 4 is a mandatory step.

* * * * *